US006189710B1

(12) United States Patent
Mason

(10) Patent No.: US 6,189,710 B1
(45) Date of Patent: Feb. 20, 2001

(54) DISPLAY DEVICE

(75) Inventor: Timothy L. Mason, Melville, NY (US)

(73) Assignee: NDR Corporation, Melville, NY (US)

( * ) Notice: Under 35 U.S.C. 154(b), the term of this patent shall be extended for 0 days.

(21) Appl. No.: 09/405,539

(22) Filed: Sep. 24, 1999

(51) Int. Cl.[7] ..... A47F 5/02; A47B 47/00

(52) U.S. Cl. ..... 211/131.1; 211/163; 211/194; 211/205

(58) Field of Search ..... 211/163, 194, 211/131.1, 133.4, 144, 196, 205

(56) References Cited

U.S. PATENT DOCUMENTS 4,548,324 * 10/1985 Mackey, Jr. ..... 211/163 X
4,609,975 * 9/1986 Badolato et al. ..... 211/194 X

* cited by examiner

*Primary Examiner*—Daniel P. Stodola
*Assistant Examiner*—Erica B. Harris
(74) *Attorney, Agent, or Firm*—Collard & Roe, P.C.

(57) ABSTRACT

A display device for displaying articles of merchandise, such as gelatin and pudding. The display device has a base having a central opening, a vertical support pole secured in the central opening of the base, a plurality of three-sided trays defining three corner areas mounted on the pole, a plurality of U-shaped filler panels disposed between at least two of the trays, a plurality of support columns mounted in the trays, and a header assembly coupled to the support pole and engaging the columns. Each tray has a plurality of edges and comprises a plurality of cantilevered shelves disposed transversely, preferably at an upward angle, relative to the pole. The trays are vertically stacked and spaced apart from each other along the support pole. The filler panels are mounted in the shelves of one of the trays and each filler panel forms an open-faced compartment for display of the article of merchandise. Each of the support columns is mounted in two of the shelves in each tray. The support columns join and close the edges of each of the trays.

9 Claims, 8 Drawing Sheets

DISPLAY DEVICE

BACKGROUND OF THE INVENTION

1. Field of the Invention

The present invention relates to display devices and more particularly to a multi-tiered rotating display suitable for displaying articles of merchandise such as gelatin and pudding products in supermarkets and other points of sale.

2. The Prior Art

At the present time there are a large variety of commercially available display devices. However, there is still a need for a display device which is easily assembled and provides an attractive way to present articles of merchandise for sale, such as boxes of gelatin and pudding.

OBJECTS AND FEATURES OF THE INVENTION

It is an object of the present invention to provide a display device which is easily assembled and disassembled.

It is a further object of the present invention to provide such a display device which may be formed of an inexpensive material, such as plastic, and yet will provide a secure and sturdy structure to display articles of merchandise.

It is a further feature of the present invention to provide such a display device which may be used to display packages of gelatin and pudding, such as JELL-O® brand gelatin.

It is a further object of the present invention to provide such a display device which may be transported disassembled in a compact state to the location where the device will be assembled.

SUMMARY OF THE INVENTION

A display device is provided for displaying multiple tiers of articles of merchandise, for example boxes of pudding and gelatin. The device has a base having a central opening, a vertical support pole secured in the central opening of the base, and a plurality of three-sided trays defining three corner areas mounted on the pole. The support pole preferably comes in an upper section and a lower section in which the upper section is inserted into the lower section to form the pole.

Each of the trays are preferably rotatably mounted on the pole and along with the base are preferably made of plastic. Each tray has a plurality of edges and a plurality of cantilevered shelves disposed transversely, preferably at an upward angle, relative to the pole. The trays are vertically stacked and spaced apart from each other along the pole. The device also has a plurality of U-shaped filler panels disposed between at least two of the trays, a plurality of support columns, and a header assembly mounted on the support pole. The filler panels are mounted in the shelves of one of the trays and form an open compartment for display of the articles of merchandise. Each of the support columns is mounted in two of the shelves of each tray. The support columns join and close the edges of each tray. The filler panels and the support columns preferably include a back section and two side sections adapted to be disposed generally perpendicular to the back section.

Additional details of the invention are contained in the following detailed description and the attached drawings in which preferred embodiments are illustrated by way of example.

BRIEF DESCRIPTION OF THE DRAWINGS

Other objects and features of the present invention will become apparent from the following detailed description considered in conjunction with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

The assembled display device of the present invention is preferably formed as a 3-sided, 5-tier rotating display tower placed at the intended point of sale. The display device may be placed anywhere at the location where the product is to be sold without using wall space. Preferably, the finished tower with product will weigh approximately 350 pounds. The display device permits customers to remove product from the display simply and easily.

Figure 1:
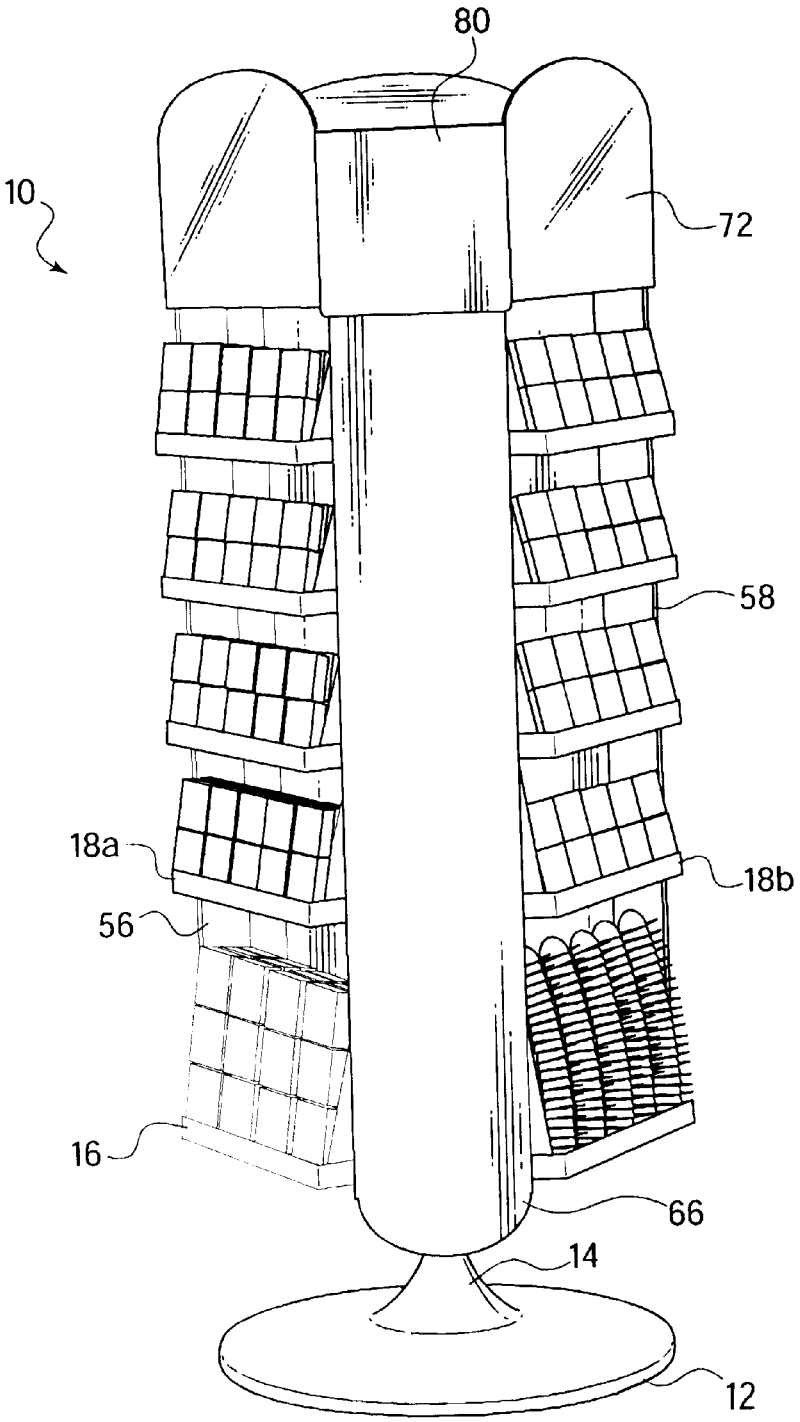
FIG. 1 is a front perspective view of an embodiment of the present invention in assembled form.
Figure 7:
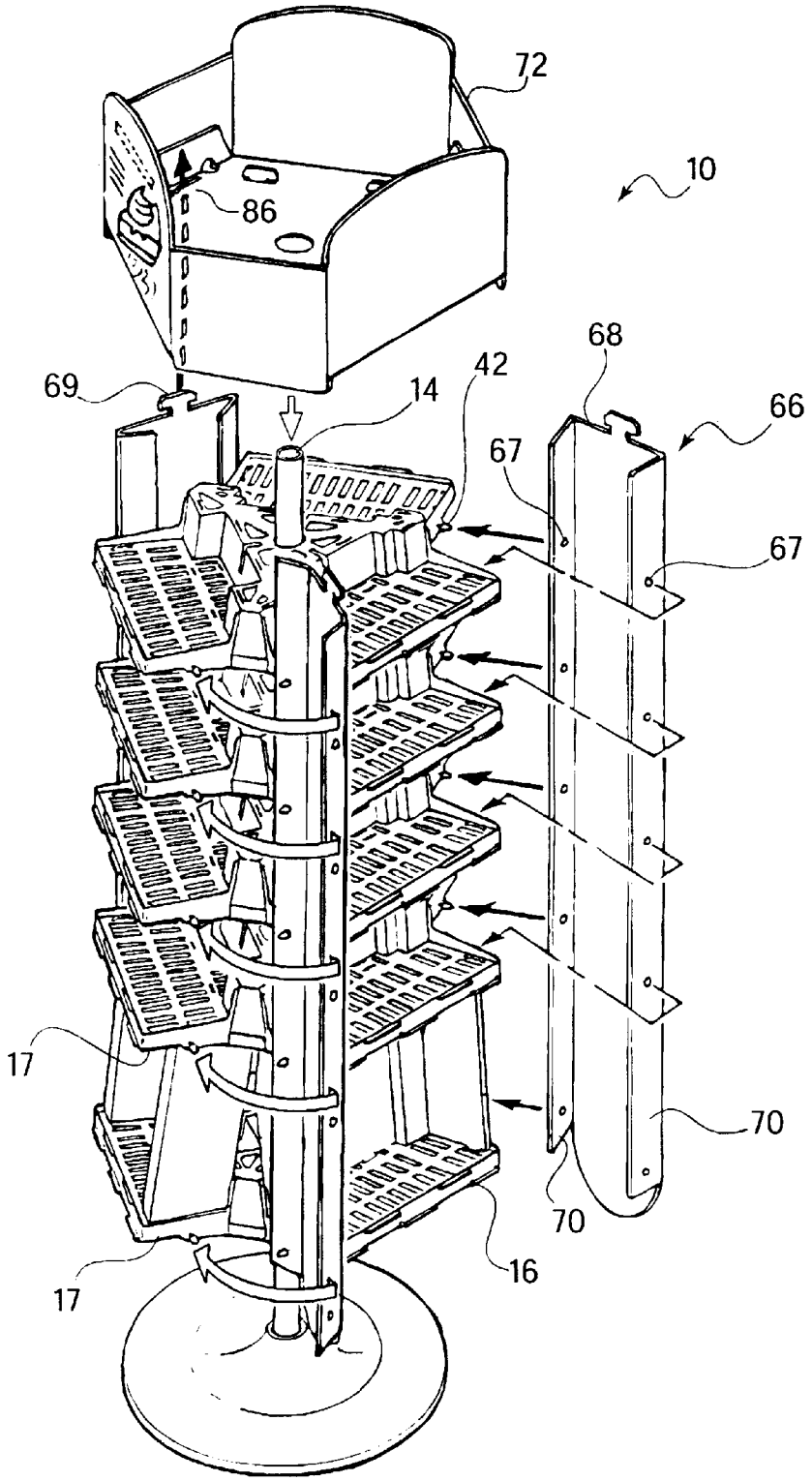
FIG. 7 is a perspective exploded view of the assembled display device.

Turning now in detail to the drawings, FIGS. 1 and 7 show an embodiment of display 10 in assembled form. Device 10 comprises a base 12, a vertical support pole 14 secured in base 12, and a plurality of three-sided trays 16 defining three corner areas 16*a* mounted on pole 14. Trays 16 are vertically stacked and spaced apart from each other along support pole 14. Preferably, the first or lowermost tray is provided with additional vertical spacing relative to the second tray immediately above it to accommodate taller stacks or larger articles of merchandise. Preferably, base 12 and trays 16 are made of plastic and the trays 16 rotatably mounted on pole 14. Base 12 has a central opening 20 for securing support pole 14.

Figure 2:
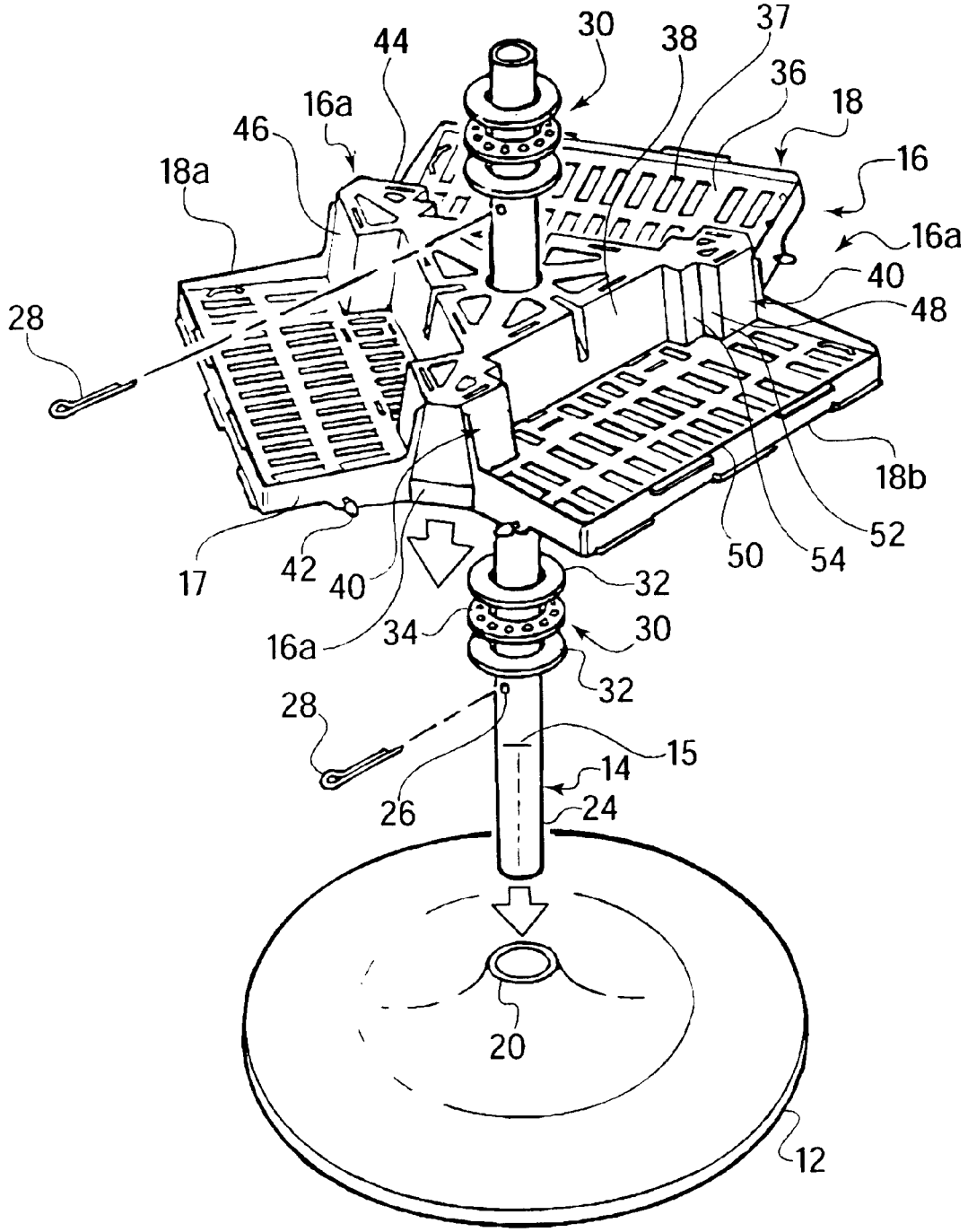
FIG. 2 is an exploded perspective view of a base, support pole, lower portion and tray incorporated in the display device of the present invention.

As shown in FIG. 2, each tray 16 comprises a plurality of edges 17 and a plurality of cantilevered shelves 18, disposed transversely, for example at an upward angle, relative to pole 14. Shelves 18 generally may be rectangular in shape as shown in FIG. 2 and have a length between 15 and 20 inches and a width between 5 and 10 inches. Each shelf 18 preferably comprises a generally flat portion 36, a back wall 38 and two flanking portions 40. Flat portion 36 has a plurality of slots 37 extending therethrough. Back wall 38 is disposed between flanking portion 40. Shelf 18 preferably also has a plurality of mounting pegs 42 located on its sides.

As shown in FIG. 2, each tray 16 preferably has at least one shelf 18*a* wherein flanking portion 40 comprises a section 44 substantially perpendicular to back wall 38 and a section 46 substantially parallel to back wall 38. Each tray 16 also preferably has at least one shelf 18*b* wherein flanking portion 40 comprises two sections 48, 50 substantially perpendicular to back wall 38 and two sections 52, 54 substantially parallel to back wall 38.

Figure 3B:
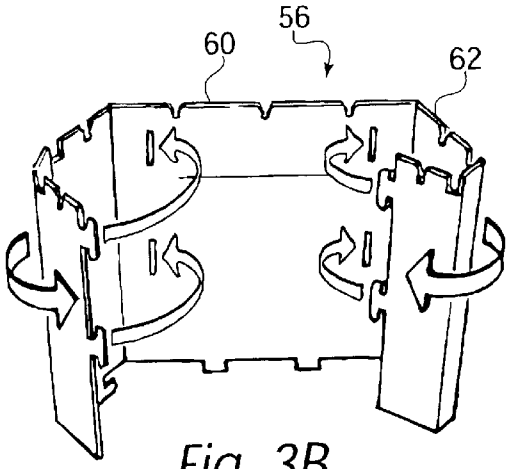
FIGS. 3A–3D are front views of the filler panels incorporated in the display device of the present invention.
Figure 3D:
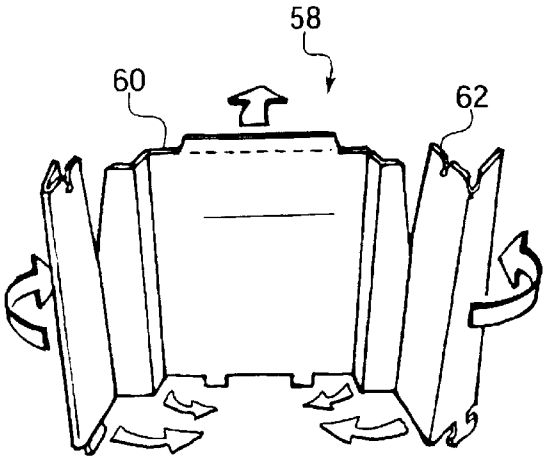
Figure 3A:
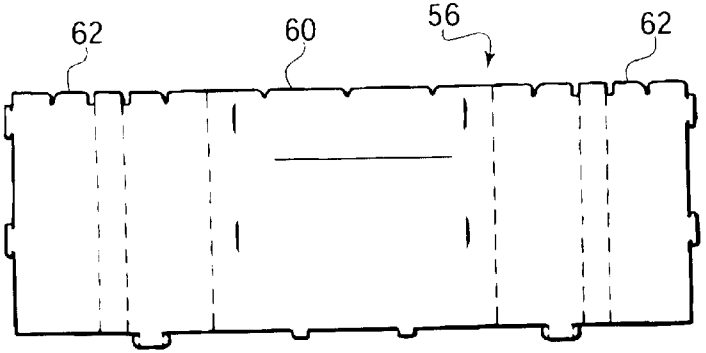
Figure 3C:
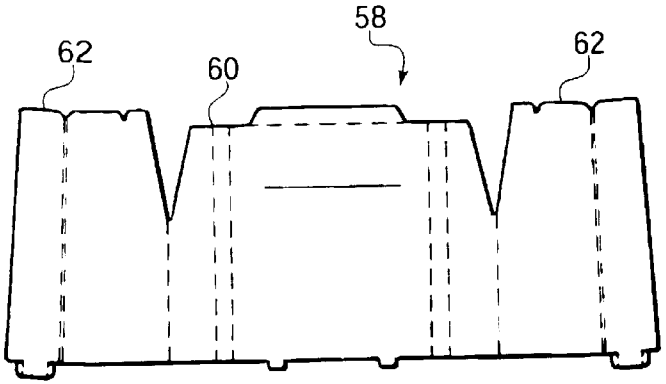
Figure 4:
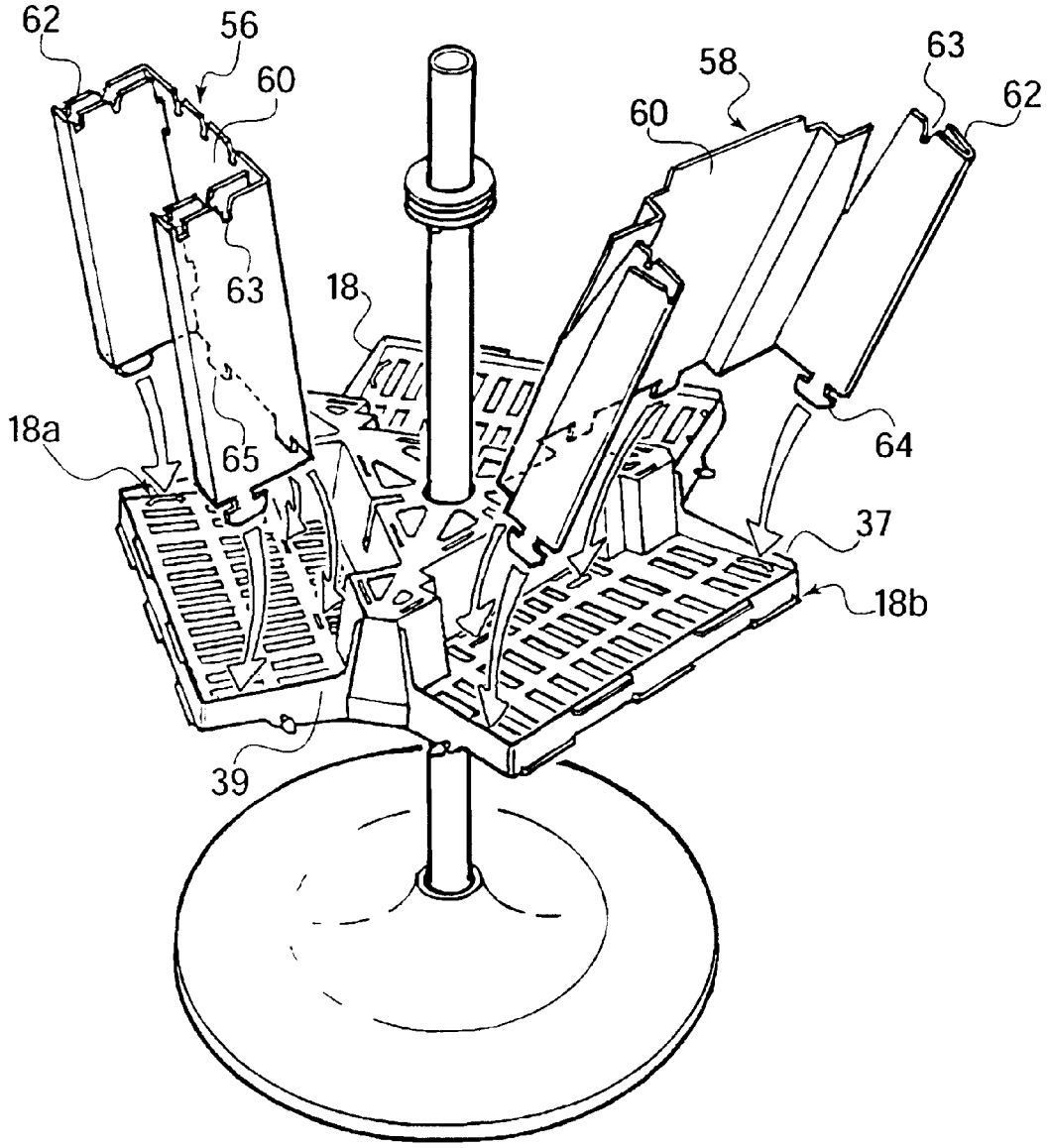
FIG. 4 is a perspective view of the base, support pole, lower portion and tray of FIG. 2 showing the filler panels of FIGS. 3B and 3D being inserted in the tray.

Device 10 also comprises a plurality of filler panels 56, 58 as shown in FIGS. 3A–3D disposed between at least two of the trays, i.e. an upper and a lower tray as shown in FIG. 7. FIGS. 3A and 3C show the panels in the unfolded state prior to assembly and FIGS. 3B and 3D show the panels being folded for assembly. As shown in FIG. 4, filler panels 56, 58 are mounted in shelves 18 of at least one of trays 16. For example, filler panel 56 is designed to be mounted in shelf 18*a* and filler panel 58 is designed to be mounted in shelf 18*b* of the lowermost tray 16 of device 10. Each filler panel forms an open-faced compartment for display of an article of merchandise.

As shown in FIGS. 3A–3D and 4, each of filler panels 56 and 58 comprise a filler panel back section 60 and two filler panel side sections 62 adapted to be disposed generally perpendicular to filler panel back section 60. As shown in FIG. 4, filler panels 56, 58 preferably have a plurality of tabs 64. Each tab 64 is adapted to be inserted into one of the slots 37 of shelf 18.

Figure 5:
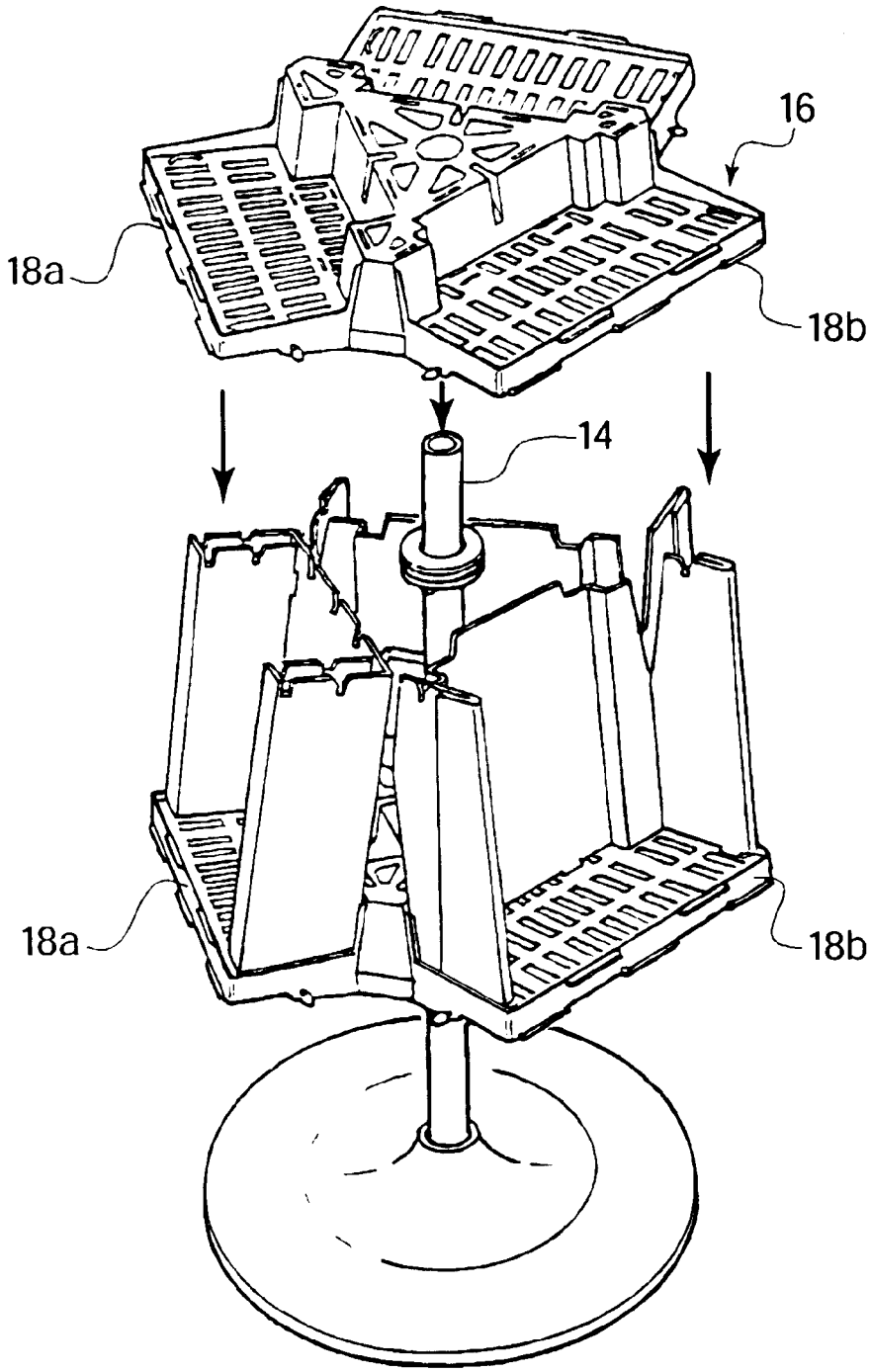
FIG. 5 is a perspective view of the base, support pole, lower portion, tray and filler panels of FIG. 4 showing an additional tray being mounted to the partial assembly.

As shown in FIG. 5, a second tray 16 is mounted on pole 14 and placed on top of filler panels 56, 58.

Figure 6:
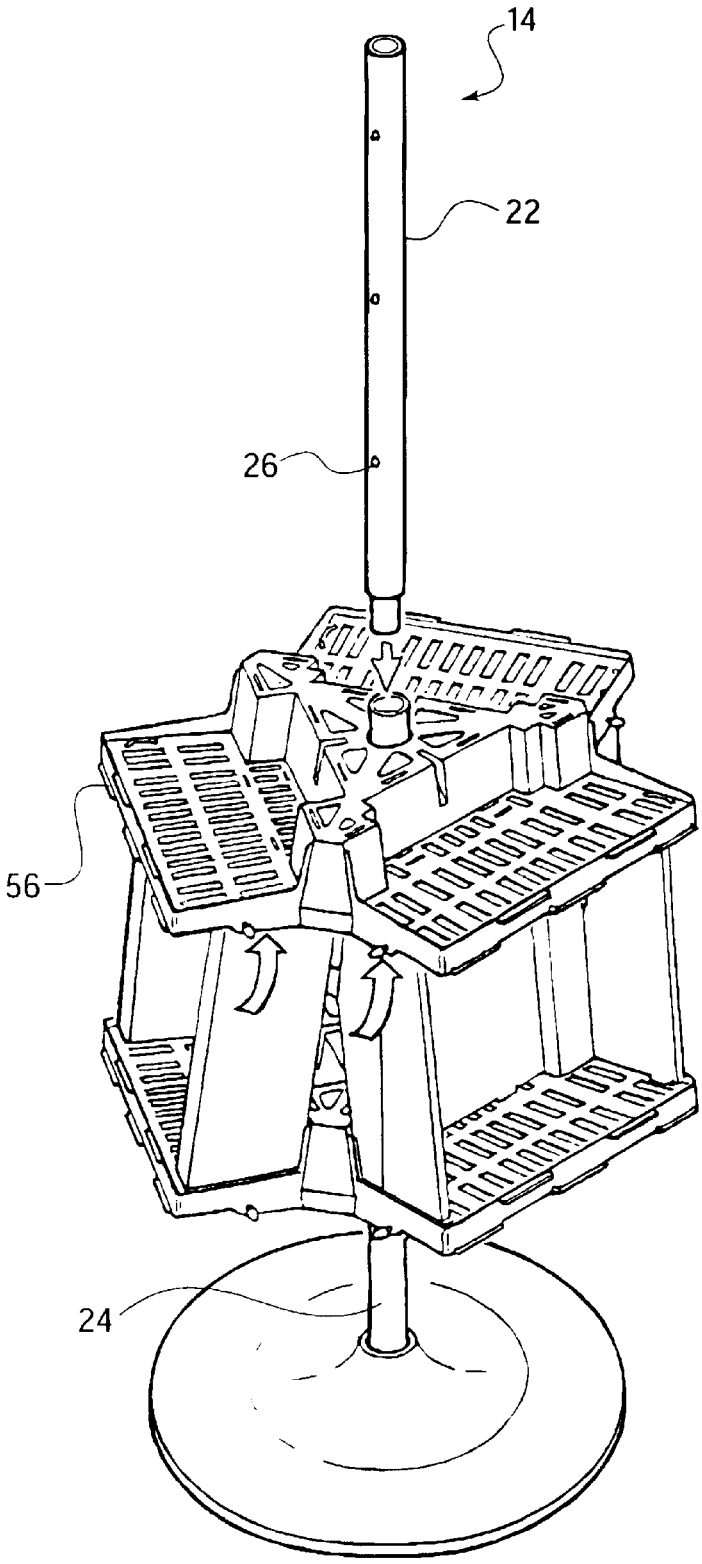
FIG. 6 is a perspective view of the partial assembly of FIG. 5 showing an upper section of the support pole being inserted in the lower section of the pole.

As shown in FIG. 6, support pole 14 preferably comprises an upper section 22 and a lower section 24 wherein upper section 22 is inserted in lower section 24 to form support pole 14. Preferably a plurality of openings 26 extend through support pole 14 into which a plurality of cotter pins 28 may be inserted as shown in FIG. 2. Cotter pins 28 support a plurality of bearing sets 30 comprising two washers 32 and a bearing race 34 arranged between washers 32.

FIG. 7 shows the partial assembly of FIG. 6 with additional trays 16 mounted. As shown in FIG. 7, display device 10 also comprises a plurality of support columns 66 mounted in trays 16. Each support column 66 is mounted in two of the shelves 18 of each tray 16. Support columns 66 have a plurality of openings 67 adapted to receive mounting pegs 42 on trays 16, thus joining and closing the edges 17 of each tray 16.

Support column 66 comprises a support column back section 68 and two support column side sections 70. Each support column side section 70 is adapted to be disposed generally perpendicular to support column back section 68 as shown in FIG. 7.

Figure 8:
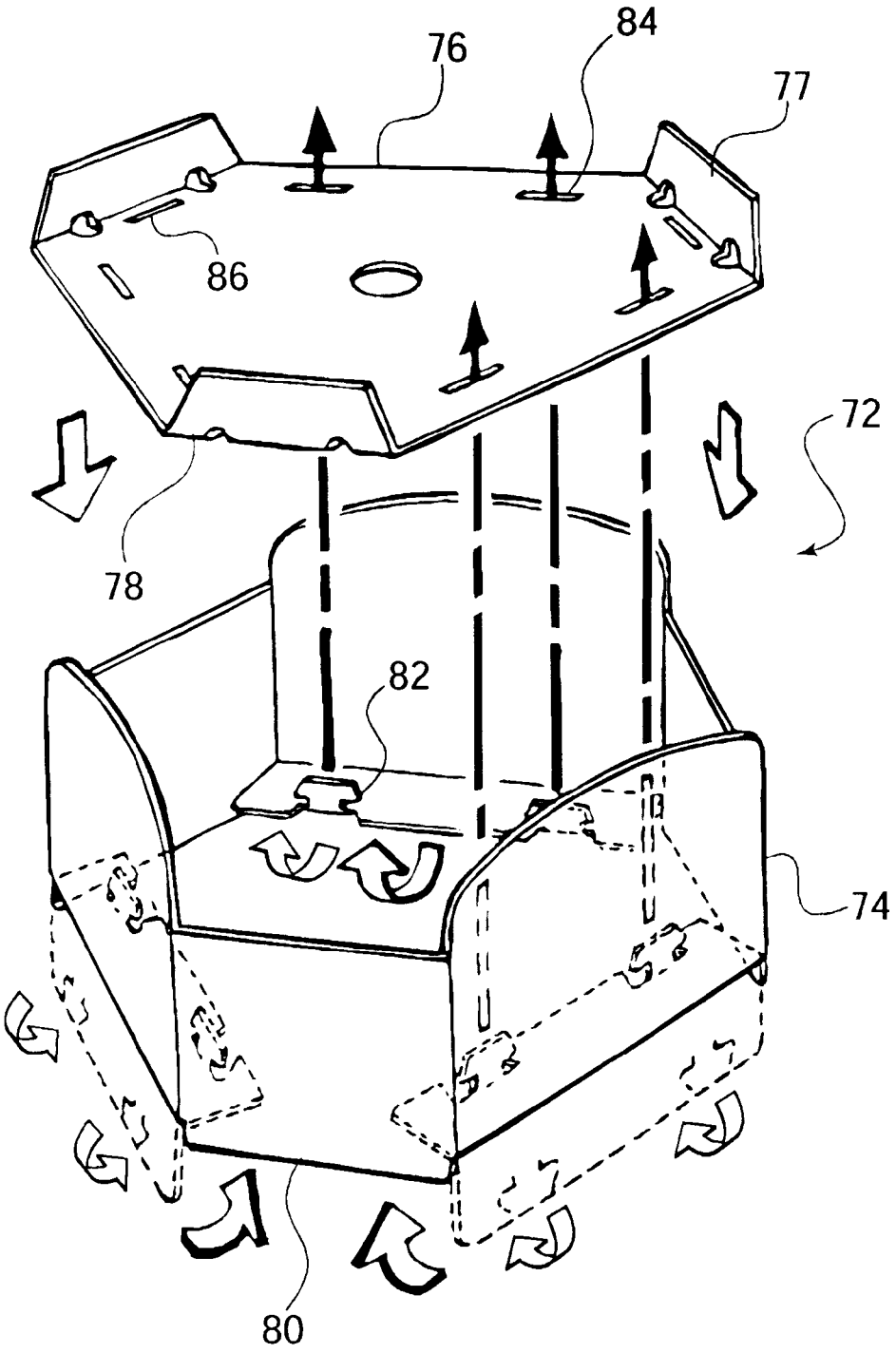
FIG. 8 is an exploded perspective view of the header assembly of FIG. 7 showing a header bottom being mounted in a header to form the header assembly.

Display device 10 also comprises a header assembly 72 as shown in FIGS. 7 and 8. FIG. 7 shows a plurality of support columns 66 and a header assembly 72 being mounted to form assembled display device 10. As shown in FIG. 7, header assembly 72 is coupled to support pole 14 and engages support columns 66. As shown in FIG. 8, header assembly 72 preferably is hexagonal in shape and comprises a header 74 and a header bottom 76 received within header 74.

Display device 10 preferably comes disassembled in a compact carton and is assembled at the intended point of sale. In assembling display device 10, lower pole section 24 is inserted completely into base 12 as shown in FIG. 2. Preferably, lower pole section 24 has markings 15 at one end to facilitate complete insertion of the correct end into base 12. A cotter pin 28 is then inserted through the lowest hole 26 in lower pole section 24 and the open ends of cotter pin 28 bent to secure it in place. Bearing set 30 is then slid into place (washer 32—bearing race 34—washer 32) as shown in FIG. 2.

A tray 16 is placed onto lower pole section 24 so as to rest on bearing set 30.

Another cotter pin 28 is placed in the next hole 26 in lower pole section 24 above the first tray 16 and the ends bent to secure the pin in place. Another bearing set 30 is then placed on pole 14 in the same manner as previously (washer 32—bearing race 34—washer 32).

Bottom shelf filler panels 56, 58 are located from the remaining disassembled parts and are creased and folded as shown in FIGS. 3B and 3D. FIG. 3B shows a filler panel 56 designed to display pudding and FIG. 3D shows a filler panel 58 designed to display gelatin. Preferably, there are two gelatin panels 58 and one pudding panel 56, and each tray 16 has two identical gelatin shelves 18*b* and one pudding shelf 18*a*.

As shown in FIG. 2, pudding shelf 18*a* has one step in the back wall and the gelatin shelves 18*b* have two steps in the back wall.

Pudding filler panel 56 is installed onto the tray 16 mounted on pole 14. As shown in FIG. 4, the front edge of the side locking tabs 64 are hooked into the side slots 37 in the bottom of shelf 18*a*. Filler panel 56 is then rotated back to engage back wall tabs 65 into straight slots 39 in shelf 18*a* as shown in FIG. 4.

The two remaining gelatin filler panels 58 are inserted in a similar manner to pudding filler panel 56. Side locking tabs 64 are marked into side slots 37 of the bottom of shelf 18*b* and panel back 60 is rotated until it is seated on shelf 18*b* and straight tabs 65 engaged in slots 39 at the back edge of shelf 18*b*.

A second tray 16 is then carefully lowered onto pole 14 making sure that similar shelves 18 are directly above each other as shown in FIG. 5. Second tray 16 is designed to nest onto the top of gelatin and pudding filler panels 56, 58.

Working with two filler panels at a time, the assembler carefully fits the adjacent edges under the shelves 18 of the tray 16 above them. Preferably trays 16 are formed with ribs which extend underneath shelves 18 between slots 37. As shown in FIG. 4, filler panels 56, 58, which may be made from corrugated material, are designed with slots 63 for receipt of the ribs at the bottom of the tray above them. In other words, the ribs of the second tray fall into slots 63 at the top of the corrugated filler panels 56, 58. The assembler rotates the entire grouping of the two trays and the corrugated pieces carefully to fit each shelf 18 of the second tray over filler panels 56, 58.

The small end of upper pole 22 is next inserted completely into the top end of lower pole 24 as shown in FIG. 6.

The remaining three trays are then installed by placing a cotter pin 28 in the next pierced hole 26 and following it with bearing set 30 as before. A tray is placed onto pole 14 and its pudding shelf 56 aligned with the previous pudding shelf 56 of the trays below. This procedure is continued until all five trays are in place.

With all the trays 16 in place and all pudding shelves 56 aligned, the support columns 66 in the form of 3-corner columns can now be installed.

Columns 66 are prepared for installation by carefully bending both sides 70 of each column 66 as shown in FIG. 7. Preferably, columns 66 are prepared with a double crease to facilitate prebending of the edges.

With the five trays in alignment as shown in FIG. 7, holes 67 in the right hand edge of a column 66 are located with pegs 42 protruding from the left side of the trays. Column 66 is then snapped onto pegs 42 on each tray 16 from top to bottom. This procedure is repeated for the left side of column 66. The remaining two columns 66 are then installed in this fashion.

The header assembly 72 shown in FIG. 8 is prepared by first preparing header 74. Preferably, header 74 is formed as a pre-cut unit with tabs and creases around the edges so as to easily form the header into a hexagon by folding the creases and bending the tabs upward. Header bottom 76 is likewise preferably designed so that it may be formed by folding the three corner tabs 77 upward. Preferably, the side of header bottom 76 intended to be placed down is made white to insure that the assembler prepares header bottom 76 correctly. One of the short sides 78 of header bottom 76 is aligned with a short side 80 of header 74 and header bottom 76 is then dropped into header 74 from the top. The six tabs 82 on the bottom of header 74 are next locked into slots 84 in header bottom 76.

The header assembly 72 is placed over column 66 as shown in FIG. 7. Preferably, header assembly 72 is designed to display advertising or artwork as shown in FIG. 1. For example, header assembly 72 may be pudding artwork with the pudding artwork aligned over pudding shelves 18*a*. Preferably, the advertising is printed on columns 66 and completely around header assembly 72. As shown in FIG. 7, column tabs 69 are aligned with slots 86 in header bottom 76. Header assembly 72 is then pulled down completely over the support columns 66. Preferably, finger holes are provided on each side of slots 86 to facilitate installation of the header assembly.

While several embodiments of the present invention have been shown and described, it is to be understood that many changes and modifications may be made thereunto without departing from the spirit and scope of the invention as defined in the appended claims.

What is claimed is:

1. A display device for displaying an article of merchandise comprising:

(a) a base having a central opening;

(b) a vertical support pole secured in the central opening of said base;

(c) a plurality of three-sided trays defining three corner areas, said trays mounted on said pole, each of said trays having a plurality of edges and comprising a plurality of cantilevered shelves disposed transversely relative to the pole, said trays being vertically stacked and spaced apart from each other along said pole;

(d) a plurality of U-shaped filler panels disposed between at least two of the trays, said panels mounted on the shelves of one of said trays to define an open compartment for each shelf for display of the article of merchandise;

(e) a plurality of support columns, mounted in said trays and joining and closing the edges of each of the trays, each of said support columns circumjacently mounted between said shelves of each of said trays; and (f) a header assembly coupled to the support pole and engaging the columns.

2. A display device according to claim 1 wherein:

(a) said base and trays are made of plastic;

(b) said pole comprises an upper section and a lower section wherein the upper section is inserted into the lower section to form the pole;

(c) each of said filler panels comprise a filler panel back section and two filler panel side sections, each of said filler panel side sections adapted to be disposed generally perpendicular to said filler panel back section;

(d) each of said support columns comprise a support column back section and two support column side sections, each of said support column side sections adapted to be disposed generally perpendicular to said support column back section; and (e) said head assembly comprises a header and a header bottom.

3. A display device according to claim 1 wherein said trays are rotatably mounted on said pole.

4. A display device according to claim 1 wherein:

(a) each of said shelves comprises a plurality of mounting pegs, a generally flat portion having a plurality of slots, and a back wall disposed between two flanking portions, each of said trays comprising (i) at least one shelf wherein each flanking portion comprises a section substantially perpendicular to said back wall and a section substantially parallel to said back wall and (ii) at least one shelf wherein each flanking portion comprises two sections substantially perpendicular to said back wall and two sections substantially parallel to said back wall;

(b) the filler panels have a plurality of tabs, each tab adapted to be inserted into one of said slots;

(c) the support columns have a plurality of openings adapted to receive said mounting pegs; and (d) the header is adapted to be formed into a hexagonal shape.

5. A display device according to claim 1 further comprising:

(a) a plurality of openings extending through said support pole;

(b) a plurality of cotter pins, each of said pins being inserted in a corresponding one of said openings; and (c) a plurality of bearing sets supported by said cotter pins comprising two washers and a bearing race arranged between said washers.

6. A display device according to claim 1 wherein the cantilevered shelves are generally rectangular in shape and have a length between 15 and 20 inches and a width between 5 and 10 inches.

7. A display device according to claim 1 wherein the cantilevered shelves are disposed at an upward angle relative to the pole.

8. A display device according to claim 1 wherein advertising is printed on the columns and completely around the header assembly.

9. A display device according to claim 1 wherein the plurality of trays includes a first lowermost tray, a second tray immediately above said first lowermost tray and a plurality of remaining trays above said second tray wherein the first lowermost tray is provided with additional vertical spacing relative to said second tray.

* * * * *